United States Patent [19]

Carney

[11] 4,026,726

[45] May 31, 1977

[54] NUCLEAR BATTERY SHOCK-SUPPORT SYSTEM

[75] Inventor: Homer Charles Carney, Del Mar, Calif.

[73] Assignee: General Atomic Company, San Diego, Calif.

[22] Filed: Dec. 1, 1975

[21] Appl. No.: 636,812

[52] U.S. Cl. ..... 136/202; 136/203; 136/221; 29/573; 128/419 P

[51] Int. Cl.[2] ..... H01V 1/02; H01V 1/12

[58] Field of Search ..... 136/202, 203, 221, 230; 62/3; 29/573; 128/419 P

[56] References Cited

UNITED STATES PATENTS

| | | | |
|---|---|---|---|
| 3,857,738 | 12/1974 | Brown | 136/202 |
| 3,865,632 | 2/1975 | Elsher et al. | 136/237 |
| 3,874,935 | 4/1975 | Goslee et al. | 136/202 |

*Primary Examiner*—Nelson Moskowitz
*Attorney, Agent, or Firm*—Fitch, Even, Tabin & Luedeka

[57] ABSTRACT

In a nuclear battery utilizing the Seebeck Effect to produce an electric voltage, a shock support system is disclosed wherein thermally conductive spring means and alignment caps support a thermoelectric converter between a heat sink and an independently supported heat source so as to cushion the converter from vibration and shock.

12 Claims, 2 Drawing Figures

NUCLEAR BATTERY SHOCK-SUPPORT SYSTEM

Figure 1:
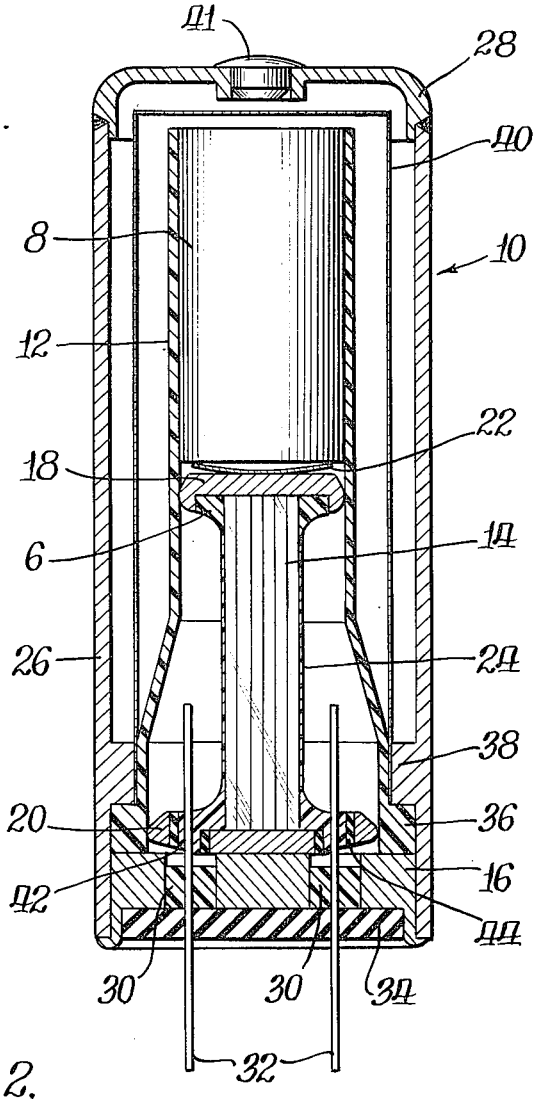

The present invention relates generally to nuclear batteries which employ a radioisotopic heat source on one end, and a heat sink on the other end of a thermoelectric converter which is constructed of doped, semiconductor elements. In accordance with the well-known Seebeck Effect, the temperature gradient across the thermoelectric converter generates an electric potential which may be used to power a variety of electrical apparatus.

More particularly, this invention relates to compact nuclear batteries of the type described above which may be inplanted into the human body to power intracorporeal, life-assisting devices. The longevity of the radioisotopic heat source (87.8 years half life) makes nuclear batteries especially useful for implantation into the human body. The long-term, relatively constant electrical output from such a battery reduces the need for repeated surgery or constant medical attention that is necessary with other types of power supplies, such as chemical reactive or rechargeable batteries. In addition, the compactness with which these nuclear batteries may be constructed makes them even more appropriate as a human implant.

However, when a battery is used to power an implanted, life-conserving device, such as a cardiac pacer, it is very important that it provide a reliable source of energy, as any disruption may have serious consequences. In particular, it must be resistant to shocks, vibrations, or other stresses which it may undergo during manufacturing, shipping, or actual use. This is a particular problem with present nuclear batteries which employ thermoelectric converters utilizing serially-connected elements of N-type and P-type semiconductor material. This type of construction is described more particularly in U.S. Pat. No. 3,780,425 which issued Dec. 25, 1973 to Penn and Neighbour, which description is incorporated by reference into this specification. Because the semiconductor elements are fragile and are connected in series, so that a single fracture, breakage, or other discontinuity in the circuit can completely disrupt the power supply, it is important that the converter be cushioned and reinforced against shocks and vibration to prevent such a disruption.

In addition, as the battery is designed for implantation, the nuclear radiation must be maintained at a sufficiently low level to avoid injury to surrounding tissue. Therefore, it is also important that any shock-support system cooperate with, or at least not impair, the insulation system within the battery to improve the thermal to electrical conversion efficiency of the battery thus minimizing the thermal requirement from the radioisotopic heat source. The lower thermal requirement allows the use of a smaller radioisotopic heat source with, accordingly, a lower level of radiation.

It is considered that present nuclear batteries do not accord sufficient protection for the thermoelectric converter to assure its use as a long-term, reliable power supply. In some nuclear batteries, the heat source is directly mounted upon the thermoelectric converter which is, in turn, bonded to the heat sink. Such rigid, cantilevered assembly is especially susceptible to shock and vibration damage, because it does not allow for any accommodation of axial and moment forces that may occur during assembling, shipping or use. Other support systems have used fibrous insulation about the various elements to cushion them against shock while simultaneously providing a barrier to heat transfer from the battery. Fibrous insulation, however, is not as efficient as other systems such as vacuum or gas insulation, and thus requires a larger thickness and results in a less compact battery to obtain a similar thermal conversion efficiency. In a further type of battery support system, the components are held together by metal tension wires which extend from the heat sink to the heat source. This system, however, provides little protection against horizontal forces and has the further problem of allowing heat transfer along the tension wires, between the heat source and sink, which may impair the efficiency of electrical generation.

Accordingly, it is a general object of this invention to provide a nuclear battery with a long-term, steady, and reliable electrical output. Another object of this invention is to provide a shock support system which will present the thermoelectric converter in a nuclear battery from shock and vibration. A further object of this invention is to provide a support system which will protect the thermoelectric converter in a nuclear battery from shock and vibration while cooperating with the battery insulation system and not detracting seriously from the thermal efficiency. These and other objects are disclosed in the following detailed description and drawings, of which, FIG. 1 is a vertical sectional view of a nuclear battery constructed in accordance with the present invention.

Figure 2:
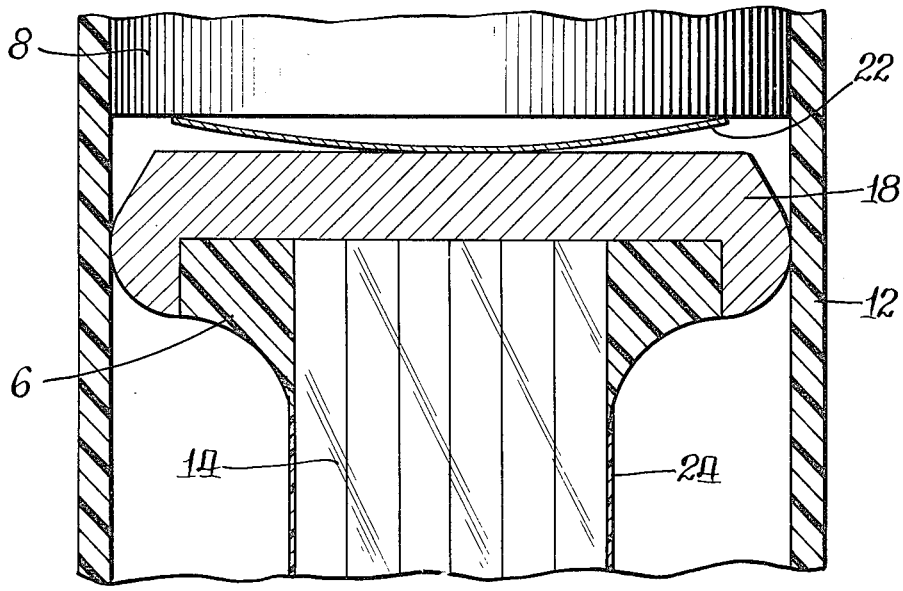

FIG. 2 is an enlarged, fragmentary view of the portion of the shock support system between the heat source and the thermoelectric converter.

The present invention is generally embodied in a nuclear battery employing a radioisotopic heat source, a heat sink and a thermoelectric converter therebetween. The temperature differential or gradient between the heat source and the heat sink causes an electric voltage to appear across the thermoelectric converter (called the Seebeck Effect), which may be used to power small electrical devices. More specifically, this invention relates to nuclear batteries of the type described above which are adaptable for implantation into the human body as power supplies for intra-corporeal, life-assisting devices.

In accordance with the present invention, a radioisotopic heat source 8 is independently supported within a battery housing 10 by a support tube 12. A thermoelectric converter 14 is secured between the heat source and a terminal cap 16, which functions as a heat sink, by thermally conductive alignment caps 18 and 20. Spring means 22 serve to isolate and cushion the converter from shock or vibration which may occur during manufacture, shipment or actual use, and a thin film 24 is bonded to the sides of the converter to further increase its resistance to fracture.

Turning now to a more detailed consideration of the preferred embodiment of the present invention, which is shown in the drawings for the purpose of illustration only, the nuclear battery housing 10 is preferably metallic, and it includes a barrel portion 26 which is closed at the upper end by the end cap 28 and at the lower or base end by the terminal cap 16, which is insertably positioned within the barrel and appropriately secured, as by welding. The terminal cap forms the base end of the battery housing and functions as the "cold" side to provide the temperature gradient across the thermoelectric converter. Glass-to-metal seals 30 are provided within the terminal cap to seal lead wires 32 which extend through the terminal cap for connection to the thermoelectric converter 14. Epoxy potting 34 on the underside of the terminal cap further seals the base of the housing and the lead wires.

To isolate the thermoelectric converter from axial and moment forces more effectively, the heat source 8 is independently supported within the battery by the upstanding support tube 12 which extends upwardly into the barrel 26. The base of the support tube includes a radially-extending, peripheral flange 36 which is sandwiched tightly between an interior barrel flange 38 and the terminal cap 16, to rigidly secure the support tube within the battery housing 10. The support tube 12 tapers upwardly from the its base to a smaller cylindrical portion which houses the heat source.

The tapered-barrel shape of the support tube 12 is especially adapted to firmly carry the heat source while efficiently maintaining a temperature gradient across the thermoelectric converter 14, which is positioned between the heat source 8 and thermal cap 16. The support tube is rigidly secured to the housing at the base end, and it is near this connection that maximum forces are likely to occur in case of shock or vibration. The conical base of the support tube is designed to minimize total conduction and radiation parasitic heat loss by providing increased strength at the high stress, cantilevered end which is also the low temperature end. The wide base of the support tube allows it to be constructed of thinner material, while maintaining sufficient strength to absorb the stress or strain that results from shock or vibration. Because the support tube is thus thinner than might be required otherwise, less heat is conducted along the support tube between the heat source and terminal cap. The smaller diameter portion of the support tube which encloses the heat source 8 diameter portion of the support tube which encloses the heat source 8 also serves to reduce radiation and conduction heat losses which increase with increased diameter (surface area) of the support tube. And to further reduce radiation heat loss, by reducing the emissivity, the support tube is vacuum-coated with a layer of gold, usually less than 0.10 microns thick.

In the preferred embodiment, the support tube 12 is 0.010 to 0.015 inches (0.0254 to 0.0381 cm) thick and is constructed of a polyimide polymer, such as that available under the trademark VESPEL SP-1 from E. I. du Pont de Nemours & Co., which is characterized by relatively high strength and comparatively low thermal conductivity. A support tube constructed of VESPEL SP-1 can adequately support the heat source 8 while limiting the transfer of heat between the heat source and the heat sink (terminal cap). Another material which may be used for the support tube is a poly(amide-imide) resin which is available under the trademark Torlon 3000, from Amoco Chemicals Corp. and which has an even lower thermal conductivity than VESPEL SP-1. Although these represent the preferred materials for construction of the support tube, any material of sufficiently high strength, low thermal conductivity, and which is thermally stable at about 100° C, may be used.

The heat source 8 is housed within the smaller, upper cylinder portion of the support tube 12. In the preferred embodiment, the heat source is made of medical-grade plutonium (90% $238PuO_2$), which is processed by well-known means to reduce undesirable radiation and chemical reaction and to make the material more compatible with container materials. The plutonium is then hot-pressed into a cermanic pellet and enclosed within a three-layer capsule for shielding against radiation and for the prevention of any accidental release of radioactive material during cremation. The capsule is described with more particularity in U.S. patent application Ser. No. 517,877 filed July 17, 1975, now U.S. Pat. No. 4,001,588 issued Jan. 4, 1977 and entitled "Radioactive Heat Source And Method Of Making Same," which description is hereby incorporated by reference into this specification. The heat source capsule is bonded by epoxy, into the upper end of the support tube, and the radioactive decay of the plutonium provides the necessary heat for the battery.

Because the battery is designed for human implantation, it is necessary that the thermal conversion efficiency be maximized to reduce nuclear radiation from the plutonium heat source. To reduce the parasitic transfer of heat to the battery housing, a reflective foil 40 radiation heat barrier is located between the support tube 12 and the battery housing 10 and the interior of the housing is filled with inert gas of low thermal conductivity inserted through seal plug 41. This insulation system is described in detail in U.S. patent application Ser. No. 543,413 filed Jan. 23, 1975 and entitled "Electric Power Generator," and the description therein is incorporated by reference as part of this specification.

The thermoelectric converter 14 is also enclosed within the support tube 12 and is spaced between the heat source 8 and the terminal cap 16. In the preferred embodiment, the thermoelectric converter is made of elongated, alternating elements of bismuth-telluride N-type and P-type semiconductor material. These elements are assembled into a converter module, with gold contacts vacuum-deposited at each end and serially connecting the various elements. Terminal contacts for electrical lead wires 32 are provided in the form of gold strips bonded by epoxy to the last N and P elements in the series. The particular method for construction of this type of thermoelectric converter may be found in U.S. Pat. Nos. 3,780,425 and 3,781,176 which issued on Dec. 25, 1973 to Penn and Neighbour, the disclosures of which are hereby incorporated into this description.

Because the fragile semiconductor elements are serially connected so that any break within the converter 14 will completely disrupt the operation of the battery, it is necessary to isolate the converter from shock, vibration and other external forces as fully as possible. To cushion the thermoelectric converter from the various bending and shock forces that may be encountered during the lifetime of the battery, alignment caps 18, 20, and spring means 22 structurally isolate the converter from the heat source 8 and the thermal cap 16. The alignment cap 18, which is more clearly shown in FIG. 2, is generally disc-shaped, with a generally flat upper surface and a recessed undersurface which is epoxy-bonded 6 to the top of the converter. The cap is preferably made of molybdenum for good thermal conduction from the heat source, and chemical compatibility with battery materials during any accidental fire or cremation.

The sides of the alignment cap which may contact the interior of the support tube are relieved so as to roll or slide when the support tube is flexed during shock or vibration. In particular, the side surface of the alignment cap has a radius of curvature of at least about 0.01 inches (0.0254 cm) and preferably about 0.015 inches (0.038 cm) in the region which is most likely to contact or rub the support tube. This curvature continues around to the underside of the cap. Upwardly of the region of contact, the side of the alignment cap slopes inwardly along a conical plane that is generally tangential to the curved portion of the side and that intersects the flat upper surface of the cap at an acute angle of about 80°.

The spring means 22 (as best seen in FIG. 2) is preferably a saucer-shaped shell of molybdenum foil approximately 0.002 inches (0.0051 cm) thick which is seated on the alignment cap 18 and opens upwardly toward the heat source 8. The spring is about 0.010 inches (0.0254 cm) high in the compressed position and about 0.015 inches high (0.0381 cm), with a radius of curvature of about 1.5 inches (3.81 cm), in the released position. The spring, in addition to cushioning the thermoelectric converter from shock also provides some allowance for variations in manufacturing tolerance. Heat is conducted across the gap between the heat source 8 and the top of the converter 14 directly via the spring and the gas-filled gap, which is not sufficiently large to materially impair thermal conduction, and by radiant heat transfer from the heat source.

Alignment cap 20 is also constructed of molybdenum and is epoxy-bonded to the base of the thermoelectric converter 14. The alignment cap 20 rests upon the terminal cap 16 which functions as the heat sink or cold side of the temperature gradient across the thermoelectric converter. As with cap 18, the side of the disc-shaped cap 20 is curved, the radius of curvature being at least about 0.01 inches (0.0254 cm) and preferably about 0.015 inches (0.0381 cm) in the region of contact with the support tube, to provide a rolling contact against the support tube and to reduce the transmission of moment forces to the converter upon shock or vibration to the support tube 12. This is to be contrasted with a rigid, cantilever connection used in some prior art batteries.

The bottom of the alignment cap 20 is also relieved to allow a rolling contact with the terminal cap 16 upon flexure or movement of the support tube. In particular, the undersurface of the alignment cap tapers upwardly from a centrally flat portion at an angle of approximately 10 degrees until it tangentially meets the curved contact portion. This small angle allows the alignment cap to rock upon flexure of the support tube. Upwardly of the region of contact, the side of the alignment cap slopes inwardly along a conical plane that is generally tangential to the contact region of the side and intersects the flat upper surface of the cap at an acute angle of about 80°.

To accommodate electrical connection to the thermoelectric converter, two holes are provided in the alignment cap 20 for the lead wires 32. Alumina insulator tubes 42, 44 insulate the wire from possible grounding against the alignment cap. The lead wires may then be connected to the gold strip terminals provided on the converter module, as earlier described.

To further reinforce the thermoelectric converter against brittle cracking and to reduce radiation heat transfer from the converter, a thin film 24 is epoxy-bonded to the exposed sides of the thermoelectric converter. Preferably, the film is a laminate about 3 mils thick, including a layer of aluminum less than 0.1 microns thick, for low emissivity, vacuum deposited on a polymer film such as that available under the trade name Kapton from the E. I. du Pont de Nemours & Co. The two layer foil of aluminum-metallized Kapton may be obtained from the National Metallizing Division of the Standard Packaging Corp.

The preferred foil is bonded to the exposed sides of the thermoelectric converter by epoxy cement. This reinforcement serves to reduce failure of the converter which is caused by stress concentrations arising from surface irregularities on the sides of the converter. The very thin aluminum layer provides a lower emissivity which reduces radiant heat transfer from the converter.

As may be seen from this description, the present invention provides a nuclear battery which is sufficiently shock resistant to withstand a variety of shocks, vibration or other stresses arising from external forces. Tests show that a battery constructed in accordance with this invention is capable of absorbing shocks greater than 3,000 g's without disrupting battery service.

Moreover, the shock support system described herein is cooperative with the other elements of the battery, e.g., the insulation system, providing improved shock resistance without interfering with the inert gas and reflective foil insulation system.

This invention has been described in terms of the preferred embodiment for purposes of explanation, and not limitation. It is not intended to disclaim the various changes which may be made in the preferred embodiment by one skilled in the art, including those changes which may be immediately apparent, such as shape or material, and others which may be developed only after study.

Various of the features of the invention are set forth in the following claims.

What is claimed is:

1. In a nuclear thermoelectric battery having a radioisotope heat source, a heat sink displaced from said heat source, and a thermoelectric converter between said heat source and said heat sink and in a thermoconductive relationship therewith, a shock support system for said thermoelectric converter, said shock support system comprising:

a first alignment cap between said converter and said heat sink, a second alignment cap between said converter and said heat source, said first and second caps being thermally conductive, said alignment caps having relieved surfaces operative to slide or rock upon battery shock or vibration, and spring means disposed between said second alignment cap and said heat source, said caps and said spring means serving to provide a thermoconductive relationship between said converter and said heat source and said heat sink, while also serving to protect said converter from shock, vibration and other external forces.

2. A shock support system in accordance with claim 1 in which said battery includes a housing and said heat source is carried by said housing.

3. A shock support system in accordance with claim 2 in which said heat source is carried by a support tube which is fixed to said housing.

4. A shock support system in accordance with claim 1 in which said converter is reinforced by a film which is bonded to the exposed surfaces of said converter.

5. A shock support system in accordance with claim 3 in which said support tube is constructed of polyimide polymer.

6. A shock support system in accordance with claim 4 in which said film is an aluminum-metallized polymer laminate.

7. A shock support system in accordance with claim 1 in which said first alignment cap includes a side surface portion having a radius of curvature of approximately 0.01 inches.

8. A shock support system in accordance with claim 1 in which said second alignment cap includes a side surface portion having a radius of curvature of approximately 0.01 inches and a tapered bottom surface portion extending from said side surface portion to a central, flat-bottom surface portion.

9. A shock support system in accordance with claim 1 in which said spring means is a saucer-shaped metal spring.

10. A nuclear, thermoelectric battery comprising a housing, a radioisotopic heat source, a heat sink spaced from said heat source, and a thermoelectric converter between said heat source and said heat sink and in thermoconductive relationship therewith, all within said housing, said heat source carried by a generally hollow support tube, said support tube being fixed within said housing, said thermoelectric converter upstanding within said support tube and spaced from said heat source by a first alignment cap and a spring disposed between said heat source and said first alignment cap, said first alignment cap having a curved side surface portion slidably contactable with said support tube, said thermoelectric converter being spaced from said heat sink by a second alignment cap, said second alignment cap having a curved side surface portion slidably contactable with said support tube and also having a tapered lower surface portion, allowing the second alignment cap to rock or shift upon said heat sink during shock or vibration, said alignment caps and said spring serving to provide a thermoconductive relationship between said converter and said heat source and said heat sink, while also serving to protect said converter from shock, vibration and other external forces.

11. A nuclear thermoelectric battery in accordance with claim 10 in which said curved side surface portion of said first alignment cap has a radius of curvature of approximately 0.01 inches and the curved said surface portion of said second alignment cap has a radius of curvature of approximately 0.01 inches.

12. A nuclear thermoelectric battery in accordance with claim 10 in which said thermoelectric converter is reinforced by a film which is bonded to the exposed surfaces of said converter.

* * * * *

UNITED STATES PATENT AND TRADEMARK OFFICE

CERTIFICATE OF CORRECTION

PATENT NO. : 4,026,726

DATED : May 31, 1977

INVENTOR(S) : Homer Charles Carney

It is certified that error appears in the above-identified patent and that said Letters Patent are hereby corrected as shown below:

Column 2, line 19 "present" should be --protect--.

Column 3, lines 35-37, delete "diameter portion of the support tube which encloses the heat source 8"

Column 4, line 54 "thermal" should be --terminal--.

Signed and Sealed this

*First* Day of *November 1977*

[SEAL]

*Attest:*

RUTH C. MASON
*Attesting Officer*

LUTRELLE F. PARKER
*Acting Commissioner of Patents and Trademark*